US011285731B2

(12) United States Patent
Clark et al.

(10) Patent No.: US 11,285,731 B2
(45) Date of Patent: Mar. 29, 2022

(54) FLUID FEED HOLE PORT DIMENSIONS

(71) Applicant: Hewlett-Packard Development Company, L.P., Fort Collins, CO (US)

(72) Inventors: Garrett E. Clark, Corvallis, OR (US); Michael W. Cumbie, Albany, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 36 days.

(21) Appl. No.: 16/764,368

(22) PCT Filed: Jan. 9, 2019

(86) PCT No.: PCT/US2019/012926
§ 371 (c)(1),
(2) Date: May 14, 2020

(87) PCT Pub. No.: WO2020/145969
PCT Pub. Date: Jul. 16, 2020

(65) Prior Publication Data
US 2021/0323315 A1 Oct. 21, 2021

(51) Int. Cl.
*B41J 2/19* (2006.01)
*B41J 2/14* (2006.01)

(52) U.S. Cl.
CPC ..... *B41J 2/19* (2013.01); *B41J 2/1404* (2013.01); *B41J 2/14145* (2013.01)

(58) Field of Classification Search
CPC ..... B41J 2/19; B41J 2/1404; B41J 2/14145
See application file for complete search history.

(56) References Cited

U.S. PATENT DOCUMENTS

| | | | |
|---|---|---|---|
| 5,278,584 | A | 1/1994 | Keefe et al. |
| 5,847,725 | A | 12/1998 | Cleland et al. |
| 6,012,644 | A | 1/2000 | Sturman et al. |
| 6,364,466 | B1 | 4/2002 | Chen et al. |
| 6,739,519 | B2 | 5/2004 | Stout et al. |
| 6,896,360 | B2 | 5/2005 | Cox et al. |
| 7,690,760 | B2 | 4/2010 | Maher et al. |
| 8,043,517 | B2 | 10/2011 | Gu et al. |
| 9,707,754 | B2 | 7/2017 | Rivas |
| 9,776,407 | B2 | 10/2017 | Rivas et al. |
| 2004/0070643 | A1 | 4/2004 | Kubota et al. |
| 2012/0019593 | A1 | 1/2012 | Scheffelin |
| 2017/0120590 | A1 | 5/2017 | Chen et al. |

FOREIGN PATENT DOCUMENTS

| | | | |
|---|---|---|---|
| EP | 0919386 | A2 | 6/1999 |
| WO | WO-WO2014018008 | A1 | 1/2014 |
| WO | WO-WO2014133517 | A1 | 9/2014 |
| WO | WO-WO2016137490 | A1 | 9/2016 |

OTHER PUBLICATIONS

IP.com search (Year: 2021).*

* cited by examiner

*Primary Examiner* — Lisa Solomon
(74) *Attorney, Agent, or Firm* — HP Inc. Patent Department

(57) ABSTRACT

A fluid ejection device may include fluid actuators, ejection chambers adjacent the fluid actuators, nozzles extending from the ejection chambers, and fluid feed holes to supply fluid from a fluid supply passage to the ejection chambers. The fluid feed holes have ports connected to the ejection chambers. The ports are sized to pass bubbles formed by the fluid actuators out of the ejection chambers.

16 Claims, 9 Drawing Sheets

FLUID FEED HOLE PORT DIMENSIONS

BACKGROUND

Fluid ejection devices eject drops on demand. Fluid ejection devices may be employed in three-dimensional (3D) printers, two dimensional (2D) printers and high precision digital dispensing devices, such as digital titration devices. Some fluid ejection devices may eject drops from nozzles by passing electrical current through heating elements that generate heat and vaporize small portions of the fluid within ejection chambers.

Figure 1:
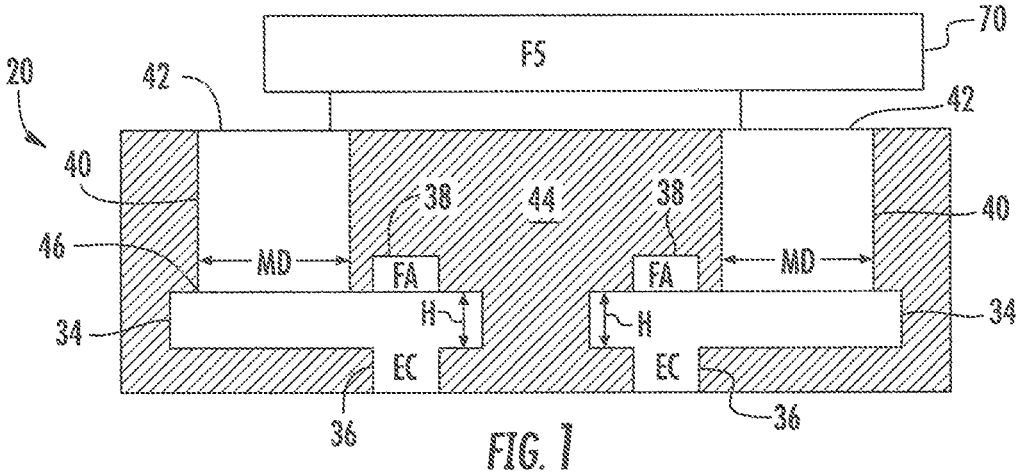
FIG. 1 is a sectional view illustrating portions of an example fluid ejection device.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed herein are example fluid ejection devices and methods that utilize fluid feed holes to supply fluid from a single fluid supply passage to ejection chambers. In contrast to fluid ejection devices which supply fluid to ejection chambers from a continuous elongate slot extending between columns of such ejection chambers and respective nozzles, the example fluid ejection devices and methods employing multiple individual fluid feed holes in place of the slot may provide enhanced mechanical robustness, may facilitate more compact and less expensive electrical connections, and may achieve more effective heat transfer. In particular, the additional structure extending between consecutive fluid feed holes may offer enhanced mechanical support for layers of materials forming the nozzles and ejection chambers, may provide surfaces for electrical trace routings from one column to another and may provide a greater surface area for the transfer of heat to the fluid being ejected to dissipate heat from the device. In many implementations, the fluid feed holes, being smaller than the slots, also facilitate higher velocity fluid flow, increasing heat transfer coefficients to further enhance the dissipation of heat from the fluid ejection device.

During use of such fluid ejection devices, bubbles may form within or near the ejection chambers. For example, in implementations where the fluid is heated to vaporize small portions of the fluid and create bubbles that expel fluid through a nozzle, the fluid ejection device may also heat up. This may result in the fluid flowing within the fluid ejection device being warmed to a temperature such that dissolved air within the fluid is released in the form of bubbles. These bubbles may block or occlude the flow of fluid to the fluid ejection chambers. Although the formation of bubbles may in some implementations be reduced by cooling the fluid or the fluid ejection device, such a solution may result in large temperature ranges or discrepancies across the fluid ejection device which may detrimentally impact ejection consistency and performance.

Rather than reducing the initial formation of bubbles, the disclosed fluid ejection devices facilitate the discharge of any bubbles that are created. The ports of the fluid feed holes of the example fluid ejection devices are specifically sized to pass such bubbles out of the ejection chambers. As a result, bubbles formed by the fluid actuators are less likely to block or impede the flow of ink from the fluid feed holes to the ejection chambers. In one implementation, the fluid ejection chambers have a height, wherein the minimum dimension of the port of each fluid feed hole is sized based upon this height so as to pass bubbles out of the ejection chambers or out of passages leading to the ejection chambers.

In one implementation, the minimum dimension of the port of each fluid feed hole is at least 1.5 times the height of the fluid ejection chamber. In high flow systems, systems having a Reynolds value of greater than 1 proximate the fluid ejection chamber, such fluid feed holes permit bubbles to be discharged through the fluid feed holes rather than being trapped between the fluid feed holes and the ejection chamber. In one implementation, the minimum dimension of the port of each fluid feed hole is at least twice the height of the fluid ejection chamber. In low flow systems, systems having a Reynolds value of less than one proximate the fluid feed chamber, such fluid feed holes permit bubbles to be discharged through the fluid feed holes rather than being trapped between the fluid feed holes in the ejection chamber.

In some of the examples of this disclosure, a fluid ejection die is provided in a molding or molded structure. The molding or molded structure includes an elongate channel or fluid supply passage for supplying fluid to the fluid feed holes. The die is embedded in the mold. The fluid supply passage is part of the molded structure and the fluid feed holes are part of the die. In one implementation, the molded structure at least partially encapsulates a single die or a plurality of parallel dies or a plurality of staggered dies. In one implementation, the molded structure comprises at least one fluid passage per die.

In one example, the die is provided in a cut out window of a PCB that is also embedded in the mold. A row of fluid feed holes extends parallel to a length axis of the elongate molding channel. Ribs between the fluid feed holes extend across the mold channel. Two rows of drop generators extend along the fluid feed hole downstream openings, for example one row at each side of the fluid feed hole openings, so that the ribs extend between the two rows of drop generators. Pillars may be provided on top of the ribs, between the drop generator rows. Pillars may also be provided near chamber inlets. A single, common manifold may be provided that fluidically connects to each of the chambers and fluid feed holes. In some example a pitch of the fluid feed holes is the same as a pitch of the drop generators in one row of drop generators.

In one example, one mold channel is to provide fluid to one fluid feed hole array (e.g. row). In another example, one mold channel may provide fluid to a plurality of feed hole arrays (e.g. rows) either in a single die or in multiple corresponding dies. In this disclosure, the dies may be of relatively small width, for example having a ratio of length to width of 20 or more, and in some implementations, 30 or more, 40 or more or 50 or more. Such dies may be called "slivers". The dies may also be relatively thin, for example generally consisting of a bulk silicon substrate and a thin film fluidics layer.

In the illustrated examples, the multiple fluid ejection devices and PCB that are mounted to a molding. In this disclosure mounting includes both attached to and embedded. In one example, the fluid ejection devices are embedded, for example overmolded, in the molding, while the PCBs are attached to the molded fluid ejection device after said embedding. The PCBs include a window that exposes the dies. In another example both the fluid ejection device and PCB are embedded in the molding.

Disclosed is an example fluid ejection device that may include fluid actuators, ejection chambers adjacent the fluid actuators, nozzles extending from the ejection chambers, and fluid feed holes to supply fluid from a single fluid supply passage to the ejection chambers. The fluid feed holes have ports connected to the ejection chambers. The ports are sized to pass bubbles formed by the fluid actuators out of the ejection chambers.

Disclosed is an example fluid ejection device that may include a substrate, a fluidic layer disposed on the substrate, drop generators formed in the fluidic layer and fluid feed holes. The drop generators may comprise respective ejection chambers, respective nozzles extending from the respective ejection chambers and respective fluid actuators. Each of the ejection chambers may have a height. The fluid feed holes extend through the substrate from a single fluid supply passage. Each of the fluid feed holes may have a port connected to at least one of the ejection chambers. The port has a minimum dimension of at least 1.5 times the height. In some implementations, the port may have a minimum dimension of at least twice the height, depending upon the anticipated fluid flow rates proximate the ejection chambers.

Disclosed is an example fluid ejection method. The method may include distributing portions of a volume of fluid amongst fluid feed holes extending through a substrate and directing the portions through the fluid feed holes to a fluidic layer. Each of the portions may be directed from the fluid feed holes to report to at least one drop generator in the fluidic layer. The lease one drop generator may conclude and ejection chamber, a fluid actuator proximate the ejection chamber and a nozzle. The ejection chamber has a height no greater than two thirds a minimum dimension of the port.

FIG. 1 schematically illustrates portions of an example fluid ejection device 20. Fluid ejection device 20 is to selectively or controllably eject droplets fluid. Fluid ejection device 20 may be employed as part of an additive or 3D printing system, may be employed as part of a two dimensional printing system in which fluid is deposited upon the two-dimensional medium, such as a sheet or web, or may be employed as part of a fluid diagnostic system, such as a system where biological, chemical or other fluid samples are identified or otherwise analyzed. Fluid ejection device 20 has an architecture or geometry that facilitates the discharge or conveyance of bubbles out of fluid ejection chambers. As a result, the existence of such bubbles is likely to interfere with the ejection of fluid from the device. Fluid ejection device 20 comprises fluid ejection chambers 34, nozzles 36, ejection elements in the form of fluid actuators 38 and feed holes 40.

Fluid ejection chambers 34, nozzles 36 and fluid actuators 38 cooperate to form drop generators. Each of fluid ejection chamber 34 comprises a volume adjacent to and between a corresponding nozzle 36 and a corresponding fluid actuator 38. In one implementation, ejection chambers 34 are isolated or disconnected from one another in that fluid supplied to one of chambers 34 is prevented from directly flowing to the other of chambers 34 without flowing through the source of the fluid, the single fluid supply 70 (shown in broken lines) that supplies and distributes a single type or characteristic fluid to both of chambers 34. In other implementations, chambers 34 may be connected to one another independent of fluid supply 70. For example, at least one fluid passage may extend directly from one chamber 34 to another chamber 34.

Nozzles 36 comprise openings extending from ejection chambers 34 through which fluid is ejected. Nozzles 36 may at least partially determine the size of the droplets being generated. In one implementation, nozzles 36 may be tapered. In other implementations, nozzles 36 may comprise un-tapered openings extending from ejection chamber 34. In one implementation, each of ejection chambers 34 has a single associated nozzle 36. In some implementations, each of ejection chambers 34 may be associated with multiple nozzles 36.

Fluid actuators 38 comprise mechanisms that displace fluid within their respective ejection chambers 34 to expel fluid through the respective nozzles 36. In one implementation, fluid actuators 38 are located directly opposite to the respective nozzles 36. In other implementations, fluid actuator 38 may be slightly offset from the respective nozzles 36.

In one implementation, fluid actuators 38 may comprise piezo-membrane based actuators, electrostatic membrane actuators, mechanical/impact driven membrane actuators, magnetostrictive drive actuators, electrochemical actuators, other such microdevices, or any combination thereof. In some implementations, the fluid actuators may displace fluid through movement of a membrane (such as a piezo-electric membrane) that generates compressive and tensile fluid displacements to thereby cause inertial fluid flow.

In some examples, each of fluid actuators 38 may comprise a thermal actuator having a heating element (e.g., a thermal resistor) that may be heated to cause a bubble to form in a fluid proximate the heating element. In such examples, a surface of a heating element (having a surface area) may be proximate to a surface of a fluid channel in which the heating element is disposed such that fluid in the fluid channel may thermally interact with the heating element. In some examples, the heating element may comprise a thermal resistor with at least one passivation layer disposed on a heating surface such that fluid to be heated may contact a topmost surface of the at least one passivation layer. Formation and subsequent collapse of such bubble may generate flow of the fluid.

As will be appreciated, each fluid actuator 38 may be connected to a controller, and electrical actuation of the fluid actuator by the controller may thereby control pumping of fluid. Actuation of the fluid actuator may be of relatively short duration. In some examples, the fluid actuator may be pulsed at a particular frequency for a particular duration. In some examples, actuation of the fluid actuator may be 1 microsecond (μs) or less. In some examples, actuation of the fluid actuator may be within a range of approximately 0.1 microsecond (μs) to approximately 10 milliseconds (ms). In some examples described herein, actuation of the fluid actuator comprises electrical actuation. In such examples, a controller may be electrically connected to a fluid actuator such that an electrical signal may be transmitted by the controller to the fluid actuator to thereby actuate the fluid actuator. Each fluid actuator of an example microfluidic device may be actuated according to actuation characteristics. Examples of actuation characteristics include, for example, frequency of actuation, duration of actuation, number of pulses per actuation, intensity or amplitude of actuation, phase offset of actuation.

In those implementations in which each of fluid actuators 38 comprise a thermal resistive fluid actuator, heat may be conducted not only to un-expelled fluid proximate the fluid actuator, but also to the physical material of fluid ejection device 20, such as silicon. This may result in fluid ejection device 20 itself heating up. Such heat may be conducted to the fluid within fluid ejection device 20 which may result in otherwise dissolved air within the fluid being released in the form of additional bubbles. In some implementations, the fluid ejection device and contained fluid may be warmed by other heat generating electronic components, other than the fluid actuators 38, to a temperature such that dissolved air within the fluid is released in the form of bubbles.

Fluid feed holes 40 comprise fluid passages that direct the flow of fluid to fluid ejection chambers 34. Fluid feed holes 40 receive fluid from a single fluid supply passage 70 (schematically illustrated). In other words, each of fluid feed holes 40 has an inlet 42 that receives fluid from the same fluid supply 70. In some implementations, fluid ejection device 20 may comprise multiple sets of fluid feed holes with each set of fluid feed holes (more than one fluid feed hole in each set) receiving fluid from or sharing a single fluid supply 70. In some implementations, each fluid supply 70, which supplies fluid to a respective set of fluid feed holes, may supply different fluids having different characteristics, such as different colors or other different properties.

As further shown by FIG. 1, each of fluid feed holes 40 generally extends in a direction parallel to the direction in which fluid is ejected through nozzles 36. Those consecutive fluid feed holes 40 that share a same fluid supply 70 are spaced by an intervening structure 44. In some implementations, each ejection chamber 34 may be supplied with fluid by several fluid feed holes 40. In yet other implementations, a fluid feed hole 40 may supply fluid to more than one ejection chamber 34.

Each of fluid feed holes 40 has an outlet port 46 directly or indirectly connected to at least one ejection chamber 34. Each outlet port is sized to pass bubbles out of or from the ejection chambers 34. In the example illustrated, each outlet port is sized based upon a height H of the ejection chamber most proximate to the outlet port 46. For example, in implementations where fluid ejection device 20 provides relatively high flow rates within fluid ejection chamber 34, flow rates having a Reynolds number of greater than 1, each outlet port 46 has a minimum dimension MD of at least 1.5 times the height. In implementations where fluid ejection device 20 provides slower flow rates within fluid ejection chamber 34, flow rates having a Reynolds number of less than or equal to one, each outlet port 46 has a minimum dimension MD of at least two times the height H. The larger minimum dimension MD of outlet port 46 further facilitates the expulsion of bubbles in such low-flow fluid ejection devices where fluid pressure offers less assistance for expelling such bubbles throughout outlet port 46.

Figure 2:
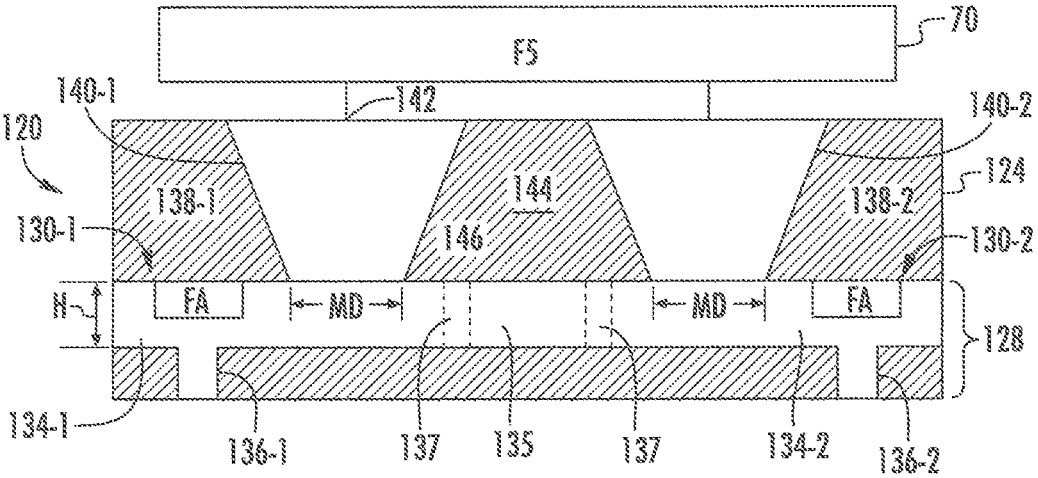
FIG. 2 is a sectional view illustrating portions of an example fluid ejection device.

FIG. 2 schematically illustrates portions of an example fluid ejection device 120. Similar to fluid ejection device 20, fluid ejection device 120 is to selectively or controllably eject droplets fluid. Fluid ejection device 120 may be employed as part of an additive or 3D printing system, may be employed as part of a two dimensional printing system in which fluid is deposited upon the two-dimensional medium, such as a sheet or web, or may be employed as part of a fluid diagnostic system, such as a system where biological, chemical or other fluid samples are identified or otherwise analyzed. Fluid ejection device 120 has an architecture or geometry that facilitates the discharge or conveyance of bubbles out of fluid ejection chambers. As a result, the existence of such bubbles is likely to interfere with the ejection of fluid from the device. Fluid ejection device 120 comprises substrate 124, fluidic layer 128, drop generators 130-1, 130-2 (collectively referred to as drop generators 130) and fluid feed holes 140-1, 140-2 (collectively referred to as holes 140).

Substrate 124 comprises a structure through which fluid feed holes 140 extend. Substrate 124 may further provide a base or supporting structure for fluid actuators of drop generators 130. In one implementation, substrate 124 comprises at least one layer of silicon. In other implementations, substrate 124 may be formed from other materials, such as ceramics, glass or the like.

Fluidic layer 128 comprises at least one layer of material disposed on substrate 124. Fluidic layer 128 forms portions of drop generators 130. In one implementation, fluidic layer 128 may be formed from materials that are easily patterned or shaped. In one implementation, fluidic layer 128 may comprise a photoresist material, such as a photoresist epoxy such as SU8. In other implementations, fluidic layer 128 may be formed from a polymer or other materials.

Drop generators 130 are formed in fluidic layer 128 and selectively eject droplets of fluid. Drop generators 130-1, 130-2 comprise fluid ejection chambers 134-1, 134-2 (collectively referred to as fluid ejection chambers 134), ejection orifices are nozzles 136-1, 136-2 (collectively referred to as nozzles 136) and fluid actuators 138-1, 138-2 (collectively referred to as fluid actuators 138), respectively. Fluid ejection chambers 134 are formed by the materials or layer(s) of fluidic layer 128. Fluid ejection chambers 134 are fluidly connected to one another by an intervening fluid passage 135. Passage 135 facilitates fluid supplied by fluid feed hole 140-1 to flow to fluid ejection chamber 134-2 or fluid supplied by fluid feed hole 140-2 to flow to fluid ejection chamber 134-1. As shown by broken lines, at least one support post 137 is formed within passage 135. Support posts 137 extend between and are directly connected to portions of fluidic layer 128 forming nozzles 136 and substrate 124. Support posts 137 support portions of fluidic layer 128 relative to substrate 124. In other implementations, passage 135 may be omitted such that a post 137 extending between the portion of fluidic layer 128 forming nozzles 136 and substrate 124 completely separate and isolate chamber 134-1 from chamber 134-2.

Fluid feed holes 140 are similar to fluid feed holes 40 except that fluid feed holes 140 are illustrated as being tapered. As with fluid feed holes 40, fluid feed holes 140 comprise fluid passages that direct the flow of fluid to fluid ejection chambers 134. Fluid feed holes 140 receive fluid from a single fluid supply passage 70 (schematically illustrated). In other words, each of fluid feed holes 140 has an inlet 142 that receives fluid from the same fluid supply 70. In some implementations, fluid ejection device 20 may comprise multiple sets of fluid feed holes with each set of fluid feed holes (more than one fluid feed hole in each set) receiving fluid from or sharing a single fluid supply 70. In some implementations, each fluid supply 70, which supplies fluid to a respective set of fluid feed holes, may supply different fluids having different characteristics, such as different colors or other different properties.

As further shown by FIG. 2, each of fluid feed holes 140 generally extends in a direction parallel to the direction in which fluid is ejected through nozzles 136. Those consecutive fluid feed holes 140 that share a same fluid supply 170 are spaced by an intervening structure 144. In some implementations, each ejection chamber 134 may be supplied with fluid by several fluid feed holes 140. In yet other implementations, a fluid feed hole 140 may supply fluid to more than one ejection chamber 34.

Each of fluid feed holes 140 has an outlet port 146 directly or indirectly connected to at least one ejection chamber 134. Each outlet port is sized to pass bubbles out of or from the ejection chambers 134. In the example illustrated, each outlet port is sized based upon a height H of the ejection chamber most proximate to the outlet port 146. For example, in implementations where fluid ejection device 120 provides relatively high flow rates within fluid ejection chamber 134, flow rates having a Reynolds number of greater than 1, each outlet port 146 has a minimum dimension MD of at least 1.5 times the height. In implementations where fluid ejection device 120 provides slower flow rates within fluid ejection chamber 134, flow rates having a Reynolds number of less than or equal to one, each outlet port 46 has a minimum dimension MD of at least two times the height H. The larger minimum dimension MD of outlet port 146 further facilitates the expulsion of bubbles in such low-flow fluid ejection devices where fluid pressure offers less assistance for expelling such bubbles throughout outlet port 146.

Figure 3:
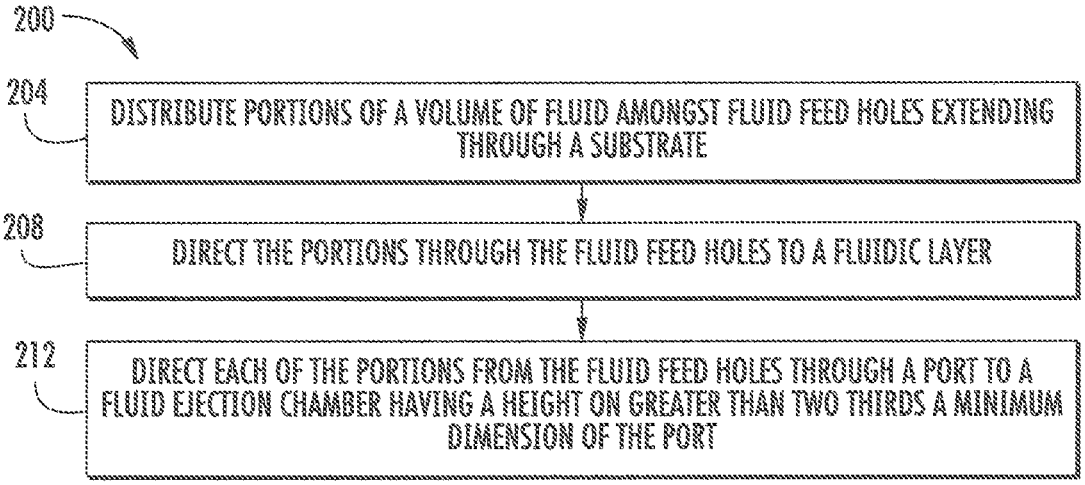
FIG. 3 is a flow diagram illustrating an example fluid supply and ejection method.

FIG. 3 is a flow diagram of an example fluid supply and ejection method 200. Method 200 facilitates the supply of fluid through individual fluid feed holes with a reduced likelihood of bubbles blocking or impeding the supply of fluid to fluid ejection chambers. Although method 200 is described in the context of being carried out by fluid ejection device 120, it should be appreciated that method 200 may likewise be carried out with any of the following described fluid ejection devices or with similar fluid ejection devices and systems.

As indicated by block 204, portions of the volume of fluid are distributed amongst different fluid feed holes extending through a substrate. As indicated by block 208, the portions of the volume of fluid are directed through the fluid feed holes to a fluidic layer. As indicated by block 212, each of the portion of the fluid is directed from the fluid feed holes through a port to a fluid ejection chamber having a height no greater than two thirds a minimum dimension of the port. As discussed above, this sizing of the ports of the fluid feed holes facilitates the passage of such bubbles away from the fluid ejection chambers through the fluid feed holes, reducing the likelihood that such bubbles may block the supply of fluid to the fluid ejection chambers.

FIGS. 4-7 illustrates portions of an example fluid ejection device 300. Fluid ejection device 300 comprises an elongated thin "sliver" fluid ejection die 302 molded into a monolithic body 304, or molding 304. In one implementation, the "sliver" fluid ejection die 302 has a length to width ratio of at least 30:1. In yet other implementations, the sliver fluid ejection die 302 has a length to width ratio of at least 40:1 or at least 50:1. Such length to width ratios may facilitate more compact fluid ejection devices and reduce die fabrication cost. The die 302 can be made of silicon. In yet other implementations, the die 302 may be formed from other materials.

The molding 304 can be formed of plastic, epoxy mold compound, or other moldable material. The fluid ejection die 302 is molded into the molding 304 such that a front surface of a fluidics layer 306 on the die 302 remains exposed outside of the molding 304, enabling the die to dispense fluid. A substrate 308 forms the back surface 310 of the die 102 which is covered by the molding 304 except at a channel 312 formed in the molding 304. The mold channel 312 enables fluid to flow directly to the die 302. In different examples, a fluid ejection device 300 includes one or multiple fluid ejection dies 302 embedded within a monolithic molding 304, with the fluid channel 312 formed in the molding 304 for each die 302 to carry fluid directly to the back surface 310 of the die 302.

In one example, the substrate 308 comprises a thin sliver in the order of 120 microns in thickness. In other implementations, the thickness may be on the order of 100 microns. The substrate 308 includes fluid feed holes 340 dry etched or otherwise formed in the substrate 308 to convey fluid through the substrate 308 from its back surface 310 to its front surface 316. In one example, the fluid feed holes 340 completely traverse a substrate 308 composed of bulk silicon. The fluid feed holes 340 are arranged in an array (i.e., a row or line) that may extend along a length (L) of the substrate 308, parallel to the mold channel 312, for example centered with respect to a width W2 of the mold channel 312. In a further example the fluid feed hole array is also centrally located with respect to a width (W) of the substrate 308. In other words, a line or row of fluid feed holes 340 may run down the center of the substrate 308 along its length (L). It is noted that the length (L) illustrated in FIG. 6, for example, is not intended to illustrate the full length of the substrate 308. Instead, the length (L) is intended to indicate the orientation of length to width of the substrate 308. As noted above, FIGS. 4-6 illustrate just a portion of an example molded fluid ejection device 300. In many instances, the substrate 308 would be significantly longer than the length (L) and the number of fluid feed holes 340 would be significantly greater than the several that are illustrated. A single mold channel 312 in the mold 304 may supply fluid to the array of fluid feed holes 340.

In the illustrated example, the fluid feed holes 340 include walls 318 that are tapered from the front surface 316 to the back surface 310 of the substrate 308. Such tapered fluid feed holes 340 have a smaller or narrower cross section at the front surface 316 of the substrate 308 and they become increasingly larger or wider as they extend through the substrate 308 to the back surface 310. In the illustrated example, the tapered fluid feed holes 340 help to manage air bubbles that develop in the fluid ejection device 300. Ink or other liquids may contain varying amounts of dissolved air, and as fluid temperatures increase during fluid drop ejections, the solubility of air in the fluid decreases. The result can be a relatively few air bubbles in the ink or other liquid thereby inhibiting certain consequences of air bubbles in the liquid which may include faulty nozzle performance or reduced print quality. During fluid ejection, because nozzles 336 may be oriented below the fluid feed holes 340, air bubbles developing in fluid ejection chambers 334 and elsewhere in the fluid ejection device 300 may tend to rise upwards through the fluid feed holes 340. Such upward motion of the air bubbles away from the nozzles 336 and chambers 334 may be assisted by the widening taper 318 in the fluid feed holes 340 as well as by this sizing of the fluid feed holes 340 relative to the height of the fluid ejection chambers 334.

In the example illustrated, each of the fluid feed holes 340 direct the flow of fluid to fluid ejection chambers 334. Fluid feed holes 340 receive fluid from a single fluid supply passage 312. In other words, each of fluid feed holes 340 has an inlet 342 that receives fluid from the same fluid supply 312. In some implementations, fluid ejection device 300 may comprise multiple sets of fluid feed holes with each set of fluid feed holes (more than one fluid feed hole in each set) receiving fluid from or sharing a single fluid supply 312. In some implementations, each fluid supply 312, which supplies fluid to a respective set of fluid feed holes, may supply different fluids having different characteristics, such as different colors or other different properties.

Figure 5:
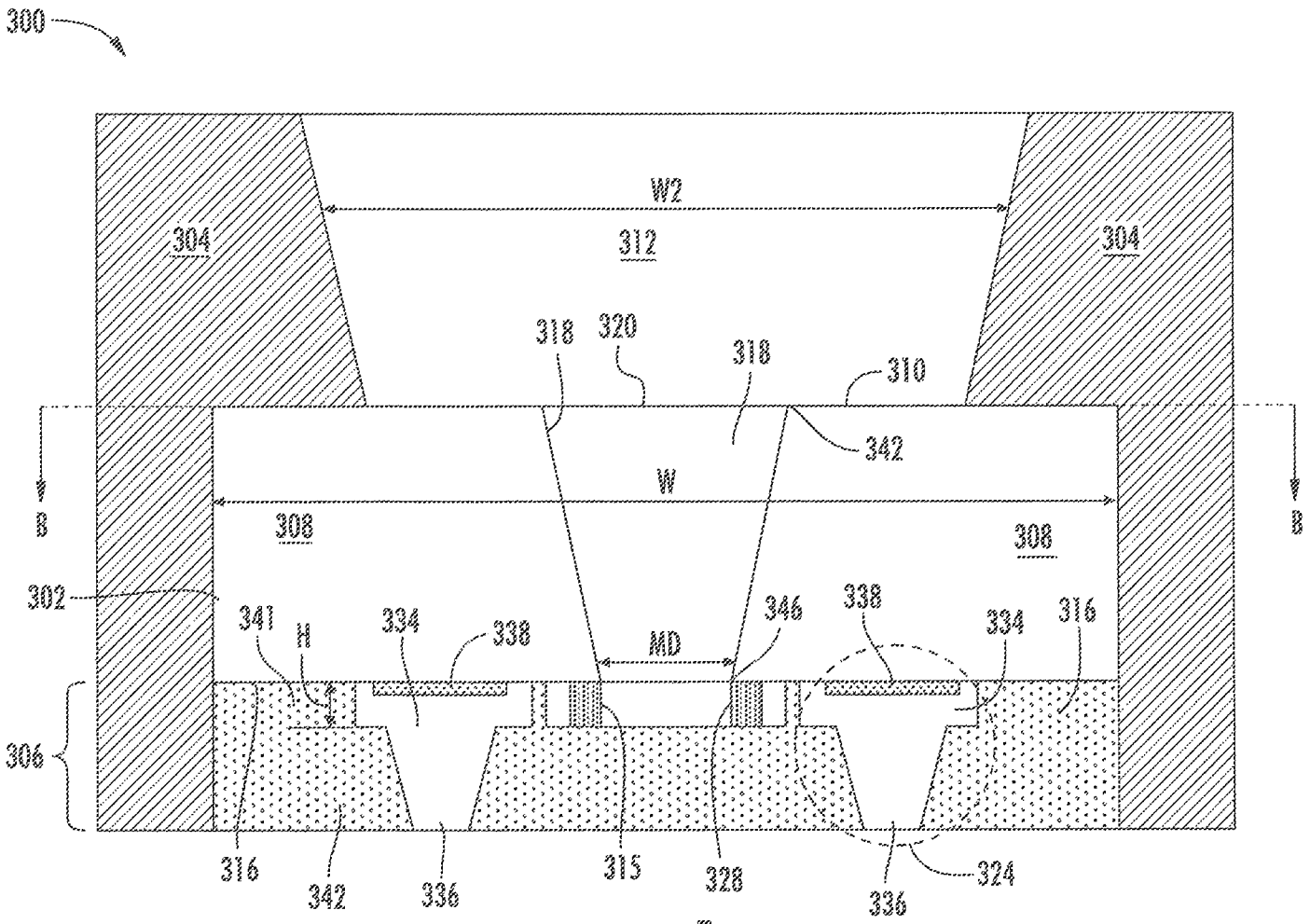
FIG. 5 is a sectional view of the example fluid ejection device of FIG. 4 taken along dashed line A-A of FIG. 4.
Figure 6:
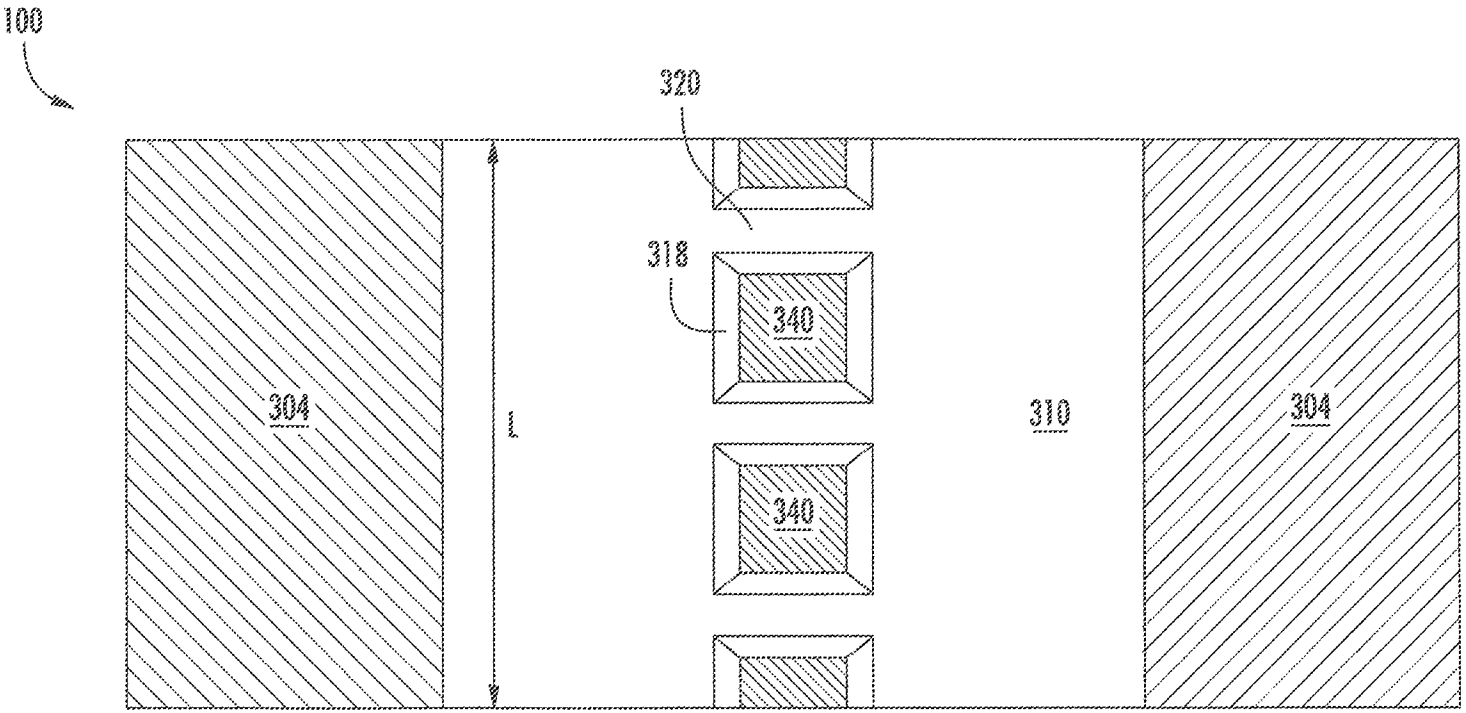
FIG. 6 is a sectional view from a top of the example fluid ejection device of FIG. 4 taken along dashed line B-B of FIG. 5.

As further shown by FIG. 5, each of fluid feed holes 340 generally extends in a direction parallel to the direction in which fluid is ejected through nozzles 336. In some implementations, each ejection chamber 334 may be supplied with fluid by several fluid feed holes 340. In yet other implementations, a fluid feed hole 340 may supply fluid to more than one ejection chamber 334.

Each of fluid feed holes 340 has an outlet port 346 directly or indirectly connected to at least one ejection chamber 334. Each outlet port 346 is sized to pass bubbles out of or from the ejection chambers 334. In the example illustrated, each outlet port 346 is sized based upon a height H of the ejection chamber most proximate to the outlet port 346. For example, in implementations where fluid ejection device 320 provides relatively high flow rates within fluid ejection chamber 334 (or within 100 um from chamber 334), flow rates having a Reynolds number of greater than 1, each outlet port 346 has a minimum dimension MD of at least 1.5 times the height. In implementations where fluid ejection device 300 provides slower flow rates within fluid ejection chamber 334 (or within 100 um from chamber 334), flow rates having a Reynolds number of less than or equal to one, each outlet port 346 has a minimum dimension MD of at least two times the height H. The larger minimum dimension MD of outlet port 346 further facilitates the expulsion of bubbles in such low-flow fluid ejection devices where fluid pressure offers less assistance for expelling such bubbles throughout outlet port 346.

The substrate 308 also includes ribs 320 or bridges that traverse the fluid channel 312 between the fluid feed holes 314 on either side of the fluid feed holes 314. The ribs 320 may result from the formation and presence of the fluid feed holes 314. Each rib 320 is positioned between two fluid feed holes 340 and extends widthwise across the substrate 308 as it traverses the underlying fluid channel 312 formed in the molding 304. In an example, the substrate is made of bulk silicon and the ribs 320 are part of the bulk silicon, traversing part of the molded channel of the mold 304.

Figure 4:
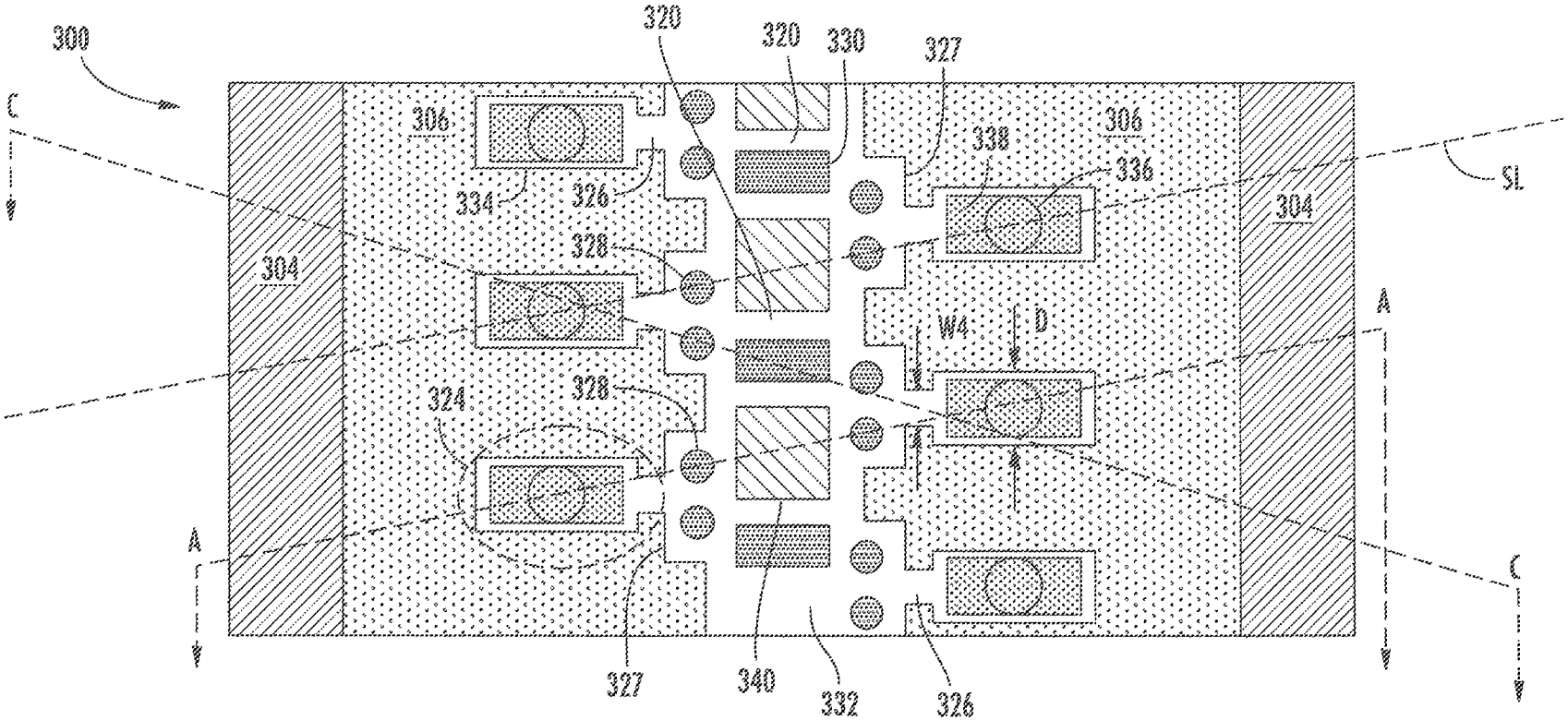
FIG. 4 is a bottom plan view illustrating portions of an example fluid ejection device.
Figure 7:
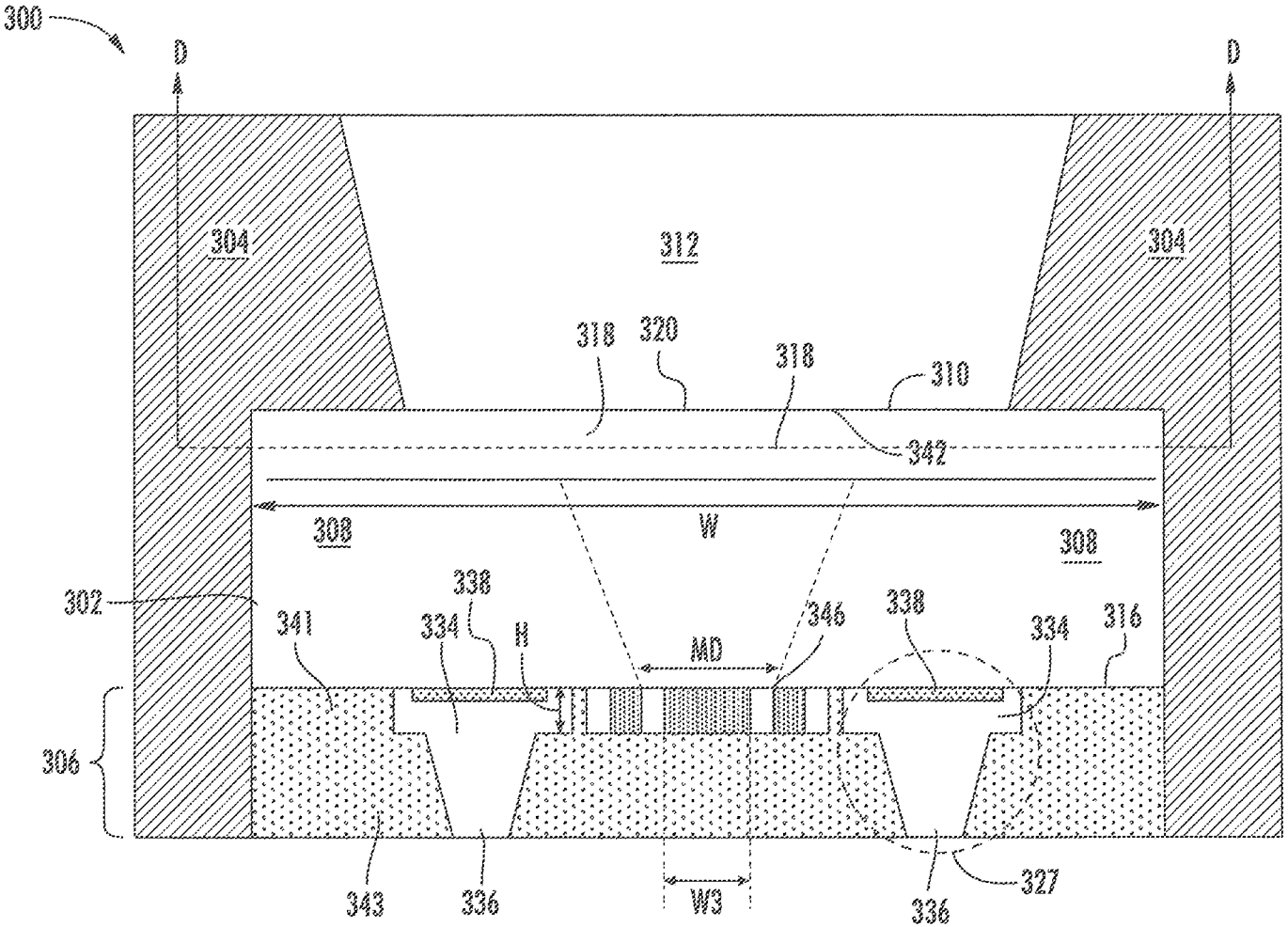
FIG. 7 is a sectional view of the example fluid ejection device of FIG. 4 taken along dashed line C-C of FIG. 4.

In FIG. 4, a dashed line C-C indicates a cross-sectional view of the fluid ejection device 300 as illustrated in FIG. 7. The cross-sectional view of fluid ejection device 300 in FIG. 7 illustrates a silicon rib 320 that extends between fluid feed holes 314 and a front and back surface 316, 310 of the substrate 308. The partially dashed line 318 in FIG. 7 represents the outline of a tapered fluid feed hole wall 340 behind (or in front of) the silicon rib 320. The widening taper 318 of the fluid feed holes 314 from the front surface 316 to the back surface 310 of the substrate 308 causes a narrowing of the ribs 320 as the ribs extend from the front surface to the back surface.

The fluid feed holes 340 with interleaved ribs 320 traversing the fluid channel 312 provide increased strength and mechanical stability to the fluid ejection die 302. This allows the die 302 to be made smaller than conventional fluid ejection dies having fluid slots cut completely through a silicon substrate.

In one example, the reduced die size may increase nozzle and drop generator density. By bringing opposite drop generators 324 (i.e. ejection chambers, resistors and nozzles) in opposite drop generator arrays closer to one another, the fluid ejection die 302 can be made of a relatively small width (W). For example, the reduction in die size of the fluid ejection die 302 in a molded fluid ejection device 100 according to an example of this disclosure may, when compared to a silicon printhead with longitudinal fluid slot, can be in the order of two to four times. For example, some of such printheads with longitudinal fluid feed slots can support two parallel nozzle arrays on a silicon die having width of approximately 2000 microns, the fluid ejection die "sliver"-in-mold of this disclosure can support two opposite, parallel nozzle arrays on a silicon die 302 having a width W of approximately 350 microns. In different examples the width W of the die 102 may be between approximately 150 and 550 microns. In further examples one or two nozzle arrays are disposed within 200 microns of substrate width W.

As illustrated in FIGS. 5 and 7, formed on the front surface 316 of substrate 308 is a fluidics layer 306. The fluidics layer 306 generally defines a fluidic architecture that includes fluid drop generators 324, pillar structures 328, 330, and a manifold channel or manifold 332. Each fluid drop generator 324 includes a fluid ejection chamber 334, a nozzle 336, a chamber inlet 326, and an ejection element 338 formed on the substrate 308 that can be activated to eject fluid from the chamber 334 through the nozzle 336. A common manifold fluidically links each fluid feed hole 340 to the inlets 326. In the illustrated example, two rows of drop generators 324 extend lengthwise at either side of the fluid feed hole array, parallel to the fluid feed hole array.

In different implementations, the fluidics layer 306 may comprise a single monolithic layer or it may comprise multiple layers. For example, the fluidics layer 306 may be formed of both a chamber layer 341 (also referred to as a barrier layer) and a separately formed nozzle layer 343 (also referred to as a top hat layer) over the chamber layer 341. All or a substantial portion of the layer or layers making up the fluidics layer 306 can be formed of an SU8 Epoxy or some other polyimide material, and can be formed using various processes including a spin coating process and a lamination process.

In a further example a location and pitch of each fluid feed hole 314 of the array is such that a center of each fluid feed hole 314 extends approximately between the centers of the closest ejection chambers 334 at either side. For example, if in a top view (e.g. FIG. 4), one would draw a straight line SL through nearest center points of approximately opposite nozzles 336, then the straight line SL would cross the center of the fluid feed hole 314 between these nozzles 336, or a center of a rib 320. In a further example, in a top view (e.g. FIG. 4), in a die 302, any line (e.g. SL) that can be drawn through a center of a fluid feed hole 314 and a center of an ejection chamber 334 is not parallel to a media advance direction.

During printing or other fluid ejections, fluid is ejected from the ejection chambers 334 through corresponding nozzles 336 and is replenished with fluid from the mold channel 312. Fluid from the channel 312 flows through the feed holes 314 and into the manifold 332. From the manifold 332, fluid flows through the chamber inlets 326 into the ejection chambers 334. Printing speeds can be increased by rapidly refilling the ejection chambers 334 with fluid. However, as fluid flows towards and into the chambers 334, small particles in the fluid can get lodged in and around the chamber inlets 326 that lead to the chambers 334. These small particles can diminish and/or completely block the flow of fluid to the chambers, which can result in the premature failure of the ejection elements 338, reduced ink drop size, misdirected ink drops, and so on. Pillar structures 328 near the chamber inlets 326 provide for a particle-tolerant architecture (PTA) that may serve, at least in part, as a barrier to prevent particles from blocking or passing through the chamber inlets 326. The placement, size, and spacing of the PTA pillars 328 are generally designed to prevent particles, even of a relatively small size, from blocking the inlets 326 to the ejection chambers 334. In the illustrated example the PTA pillars 328 are disposed adjacent to the inlet. For example, two PTA pillars 328 can be provided at a distance to the inlet opening of approximately two times a pillar diameter or less, or approximately one time a pillar diameter or less. In a further example, at least one PTA pillar 328 is disposed in an inlet bay 327 into which an inlet 326 opens. In such example, inlet bay 327 arrays may be provided in the manifold side walls, between the manifold 332 and each inlet 326. In other examples, one or three PTA pillars 328 or more can be provided near the inlet 326, to inhibit migration of particles towards the chambers 334.

In a further example, the inlet 326 to the chamber 334 is pinched, that is, a maximum width W4 of each inlet 326 is less than a diameter D of each corresponding chamber 334, wherein the direction of the measured width W4 and diameter D is parallel to a length axis of the manifold 332 or to the length axis of the fluid feed hole array. For example, the maximum width W4 of the inlet 326 is less than two third of a diameter D of the chamber. In one example, the pinch point may reduce cross talk. In another example, the pinched inlet may reduce influences of variations in fluid feed hole size, position or lengths.

Additional pillar structures 330 comprise bubble-tolerant architectures 330 (BTA) that are generally configured to impede the movement of air bubbles through the die manifold 332 and to guide air bubbles into the tapered fluid feed holes 314 where they can float upward and away from the downward facing drop generator nozzles 336. The BTA pillars 330 can be disposed in the manifold 332 between the fluid feed hole openings 346 on top of the ribs 320. In an example, the BTA pillars 330 may have a larger volume or width than the PTA pillars 328. For example, the BTA pillars may have a width W3 that is at least half the diameter of the fluid feed hole opening 246 into the manifold 332, for example approximately the same as the diameter of the fluid feed hole opening 346 into the manifold 332. It is noted that although in this illustrative description it has been chosen to denominate the pillars 328, 330 as "PTA" and "BTA" pillars, in different examples the functions and advantages of the pillars 328, 30 may vary and are not necessarily (only) related to the particles or bubbles, respectively, but may have additional or different functions and advantages.

In further examples the pillar structures 328, 330 serve the purpose of mitigating fluidic cross-talk between neighboring drop generators 324 that are in close proximity with one another, for example in addition to, or instead of, mitigating a negative influence of bubbles and/or particles. As previously noted, a smaller fluid ejection die 302 in the molded fluid ejection device 300 is enabled in part by the presence of fluid feed holes 340 and the associated ribs 320 that traverse the fluid channel 312 and add strength to the substrate 308. The reduced die size increases nozzle and drop generator density by bringing drop generators closer to one another across the channel 312 and width (W) of the substrate 308. The relatively high nozzle density in the fluid ejection device 300 could result in a relatively high level of fluidic cross-talk between neighboring drop generators 324. That is, as fluid drop generators are brought in closer proximity to one another, increasing fluidic cross-talk between neighboring ejection chambers can cause fluid pressure and/or volume changes in the chambers that may adversely impact drop ejections. In certain examples, the pillar structures 328, 330 structures in the fluidics layer 306 may serve to mitigate the impact of fluidic cross-talk.

The fluid ejection device 300 includes the fluid channel 312 who serves as a single fluid supply passage from multiple fluid feed holes 344. The fluid channel 312 is formed through molded body 304 to enable fluid to flow directly onto the silicon substrate 308 at the back surface 310, and into the substrate 308 through the fluid feed holes 344. The fluid channel 312 can be formed in the molded body 304 in a number of ways. For example, a rotary or other type of cutting saw can be used to cut and define the channel 312 through the molded body 304 and a thin silicon cap (not shown) over the feed holes 314. Using saw blades with differently shaped peripheral cutting edges and in varying combinations, channels 312 can be formed having varying shapes that facilitate the flow of fluid to the back surface 310 of the substrate. In other examples, at least part of the channel 312 can be formed as the fluid ejection die 302 is being molded into the molded body 304 of the fluid ejection device 300 during a compression or transfer molding process. A material ablation process (e.g., powder blasting, etching, lasering, milling, drilling, electrical discharge machining) can then be used to remove residual molding material. The ablation process may enlarge the channel 312 and complete the fluid pathway through the molded body 304 to the fluid feed holes 314. When a channel 312 is formed using a molding process, the shape of the channel 312 generally reflects the inverse shape of the mold chase topography being used in the process. Accordingly, varying the mold chase topographies can yield a variety of differently shaped channels that facilitate the flow of fluid to the back surface 310 of the silicon substrate 308.

Figure 8:
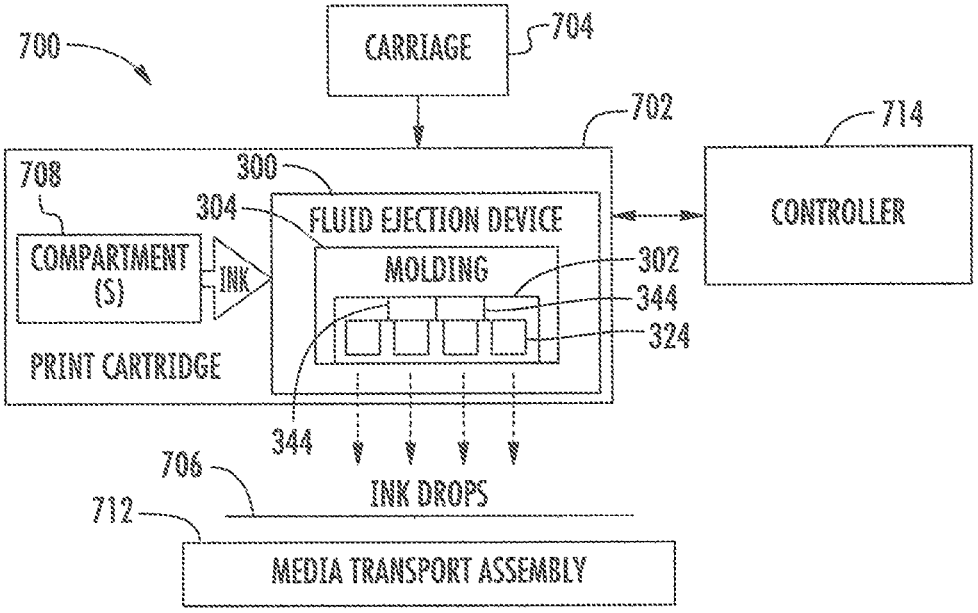
FIG. 8 is a block diagram illustrating portions of an example printer with an example print cartridge that incorporates an example of the fluid ejection device of FIG. 4.

As noted above, the molded fluid ejection device 300 is suitable for use in, for example, a replaceable fluid ejection cartridge and/or a media-wide fluid ejection assembly ("print bar") of a 2D or 3D printer. FIG. 8 is a block diagram illustrating an example of a printer 700 with a replaceable print cartridge 702 that incorporates an example fluid ejection device 300, the fluid ejection device including a molding 304 and a die 302 embedded in the molding 304. The die includes fluid feed holes 344. In an example the printer is an inkjet printer and the cartridge 702 includes at least one ink compartment 708 that is at least partially filled with ink. Different compartments may hold different colors of ink. In one example of the printer 700, a carriage 704 scans print cartridge 702 back and forth over a print media 706 to apply ink to media 706 in a desired pattern. During printing, a media transport assembly 712 moves print media 706 relative to the print cartridge 702 to facilitate the application of ink to media 706 in a desired pattern. Controller 714 generally includes a processor, memory, electronic circuitry and other components to control the operative elements of the printer 700. The memory stores instructions to control the operative elements of the printer 700.

Figure 9:
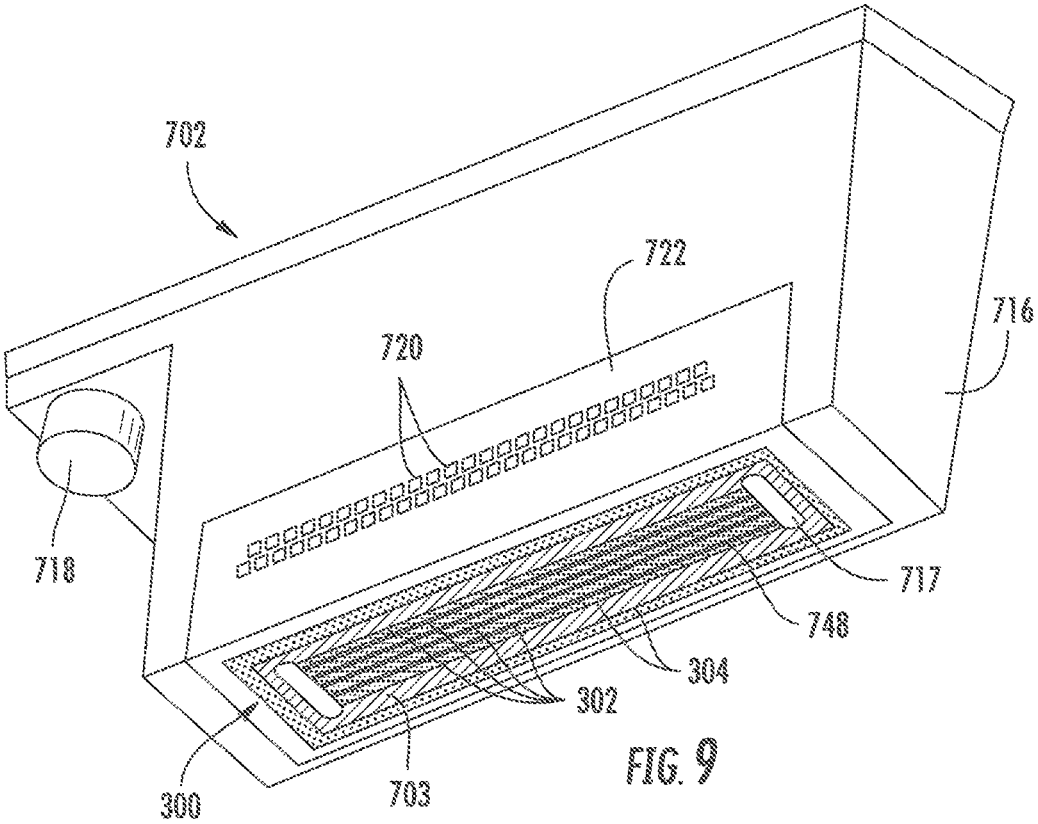
FIG. 9 is a perspective view of an example print cartridge that incorporates the example fluid ejection device of FIG. 4.

FIG. 9 illustrates a perspective view of an example print cartridge 702. The print cartridge 702 includes a molded fluid ejection device 300 supported by a cartridge housing 716. Fluid ejection device 300 includes four elongated fluid ejection dies 302 and a PCB (Printed Circuit Board) 303 mounted to a molding 304. As shown by FIG. 7, molding 304 comprises a molded structure that includes an elongate channel or fluid supply passage 312 for supplying fluid to the fluid feed holes of a die. In the example illustrated in which fluid ejection device 300 includes four fluid ejection dies 302, molding 304 comprises at least four fluid supply passages 312, at least one fluid supply passage 312 for each of the four fluid ejection dies 302. In the example illustrated, each of the four dies is embedded in the molding 304, wherein fluid supply passage is part of the molded structure and the fluid feed holes are part of the die. In one implementation, the molded structure provided by molding 304 at least partially encapsulates each of the dies 302.

The PCB may include electric and electronic circuitry such as drive circuitry to drive the fluid ejection elements in each die 102. In the illustrated example, the fluid ejection dies 102 are arranged parallel to one another across the width of fluid ejection device 100. The four fluid ejection dies 302 are located within a window 748 that has been cut out of PCB 703. While a single fluid ejection device 300 with four dies 302 is illustrated for print cartridge 702, other configurations are possible, for example with more fluid ejection devices 300 each with more or fewer dies 302.

The print cartridge 702 can be electrically connected to the controller 714 through electrical contacts 720. In an example, the contacts 720 are formed in a flex circuit 722 affixed to the housing 716, for example along one of the outer faces of the housing 716. Signal traces embedded in flex circuit 722 may connect the contacts 720 to corresponding circuitry on the fluid ejection die 302, for example through bond wires covered by a low profile protective cover 717 at the extremes of the fluid ejection dies 102. In an example, ejection nozzles on each fluid ejection die 102 are exposed through an opening in, or next to an edge of, the flex circuit 722 along the bottom of cartridge housing 716.

Figure 10:
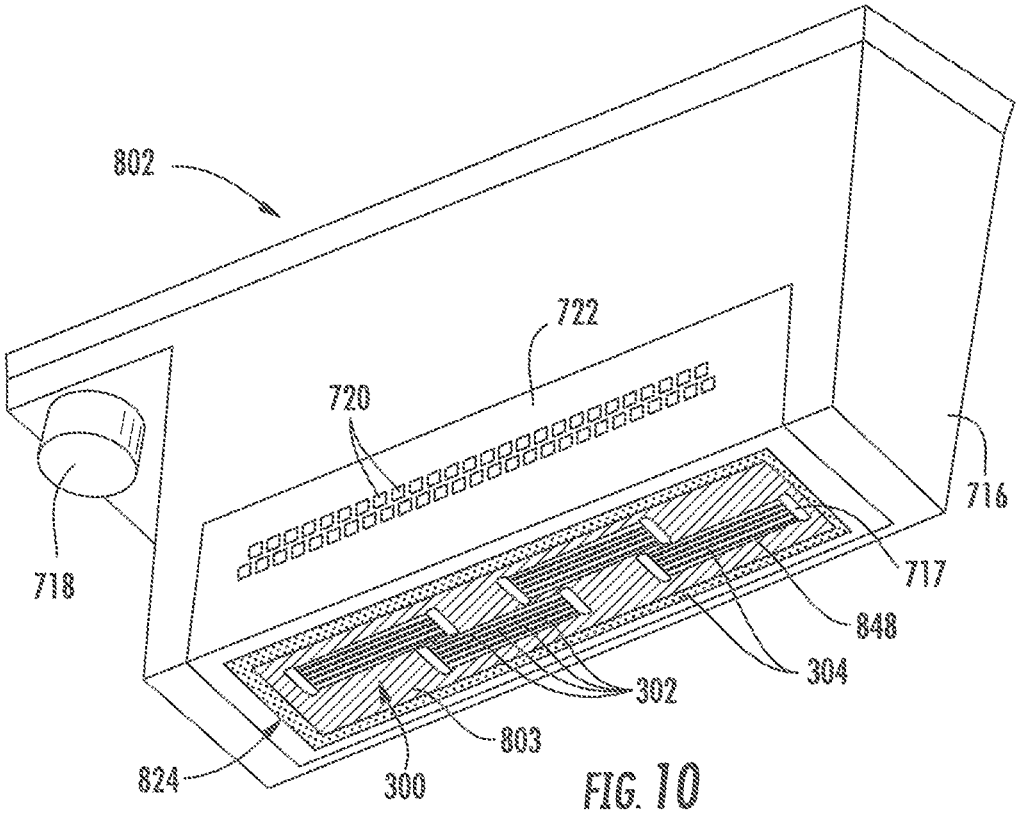
FIG. 10 is a perspective view of an example print cartridge that incorporates an example of the fluid ejection device of FIG. 4.

FIG. 10 illustrates a perspective view of another example print cartridge 802 suitable for use in a printer 700 or any other suitable high precision digital dispensing device. In this example, the print cartridge 802 includes a media wide fluid ejection assembly 824 with four fluid ejection devices 300 and a PCB 803 mounted to a molding 304 and supported by the cartridge housing 716. Each fluid ejection device 300 includes four fluid ejection dies 302 and is located within a window 848 cut out of the PCB 803.

As shown by FIG. 7, molding 304 comprises a molded structure that includes an elongate channel or fluid supply passage 312 for supplying fluid to the fluid feed holes of a die. In the example illustrated in which each fluid ejection device 300 includes four fluid ejection dies 302, molding 304 comprises at least four fluid supply passages 312, at least one fluid supply passage 312 for each of the four fluid ejection dies 302. In the example illustrated, each of the four dies 302 is embedded in the molding 304, wherein fluid supply passage is part of the molded structure and the fluid feed holes are part of the die. In one implementation, the molded structure provided by molding 304 at least partially encapsulates each of the dies 302.

While a printhead assembly 824 with four fluid ejection devices 300 is illustrated for this example print cartridge 802, other configurations are possible, for example with more or fewer fluid ejection devices 300 that each have more or fewer dies 302. At each back side of each die 302, a mold channel may be provided through the molding 304 to supply fluid to a fluidics layer of each die. At either end of the fluid ejection dies 302 in each fluid ejection device 300 bond wires may be provided, for example covered by a low profile protective coverings 717 comprising a suitable protective material such as an epoxy, and a flat cap placed over the protective material. Electrical contacts 720 are provided to electrically connect the fluid ejection assembly 724 to a printer controller 714. The electrical contacts 720 may connect to traces embedded in a flex circuit 722.

Figure 11:
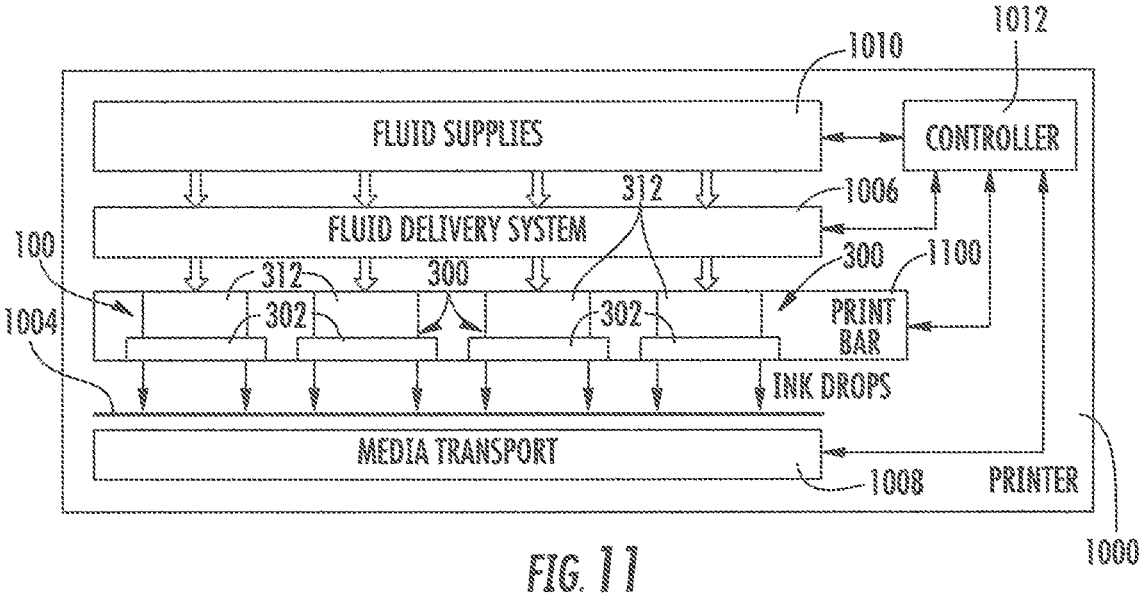
FIG. 11 is a block diagram of an example printer with an example media wide fluid ejection assembly including the example fluid ejection device of FIG. 4.

FIG. 11 is a block diagram illustrating a printer 1000 with a fixed media wide fluid ejection assembly 1100 implementing another example of a molded fluid ejection device 100. Printer 1000 includes media wide fluid ejection assembly 1100 spanning the width of a print media 1004, a fluid delivery system 1006 associated with fluid ejection assembly 1100, a media transport mechanism 1008, a receiving structure for fluid supplies 1010, and a printer controller 1012. Controller 1012 includes a processor, a memory having control instructions stored thereon, and electronic circuitry and components needed to control the operative elements of a printer 1000. The fluid ejection assembly 1100 includes an arrangement of fluid ejection dies 302 for dispensing fluid on to a sheet or continuous web of paper or other print media 1004. In operation, each fluid ejection die 302 receives fluid through a flow path that runs from supplies 1010 into, through the fluid delivery system 1006 and fluid channels 312 into the fluid ejection dies 302.

Figure 12:
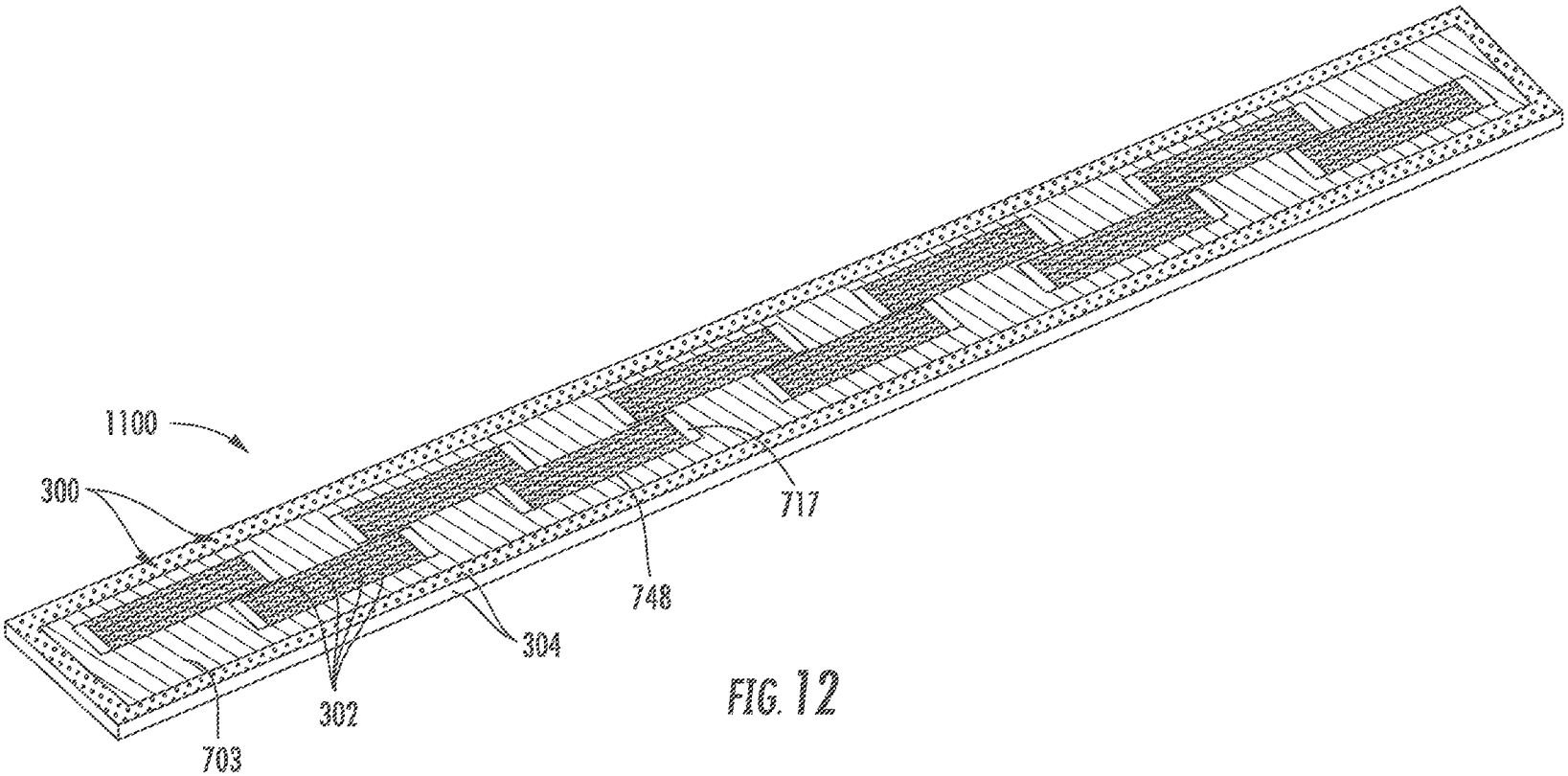
FIG. 12 is a perspective view of an example fluid ejection assembly including the example fluid ejection device of FIG. 4.
Figure 13:
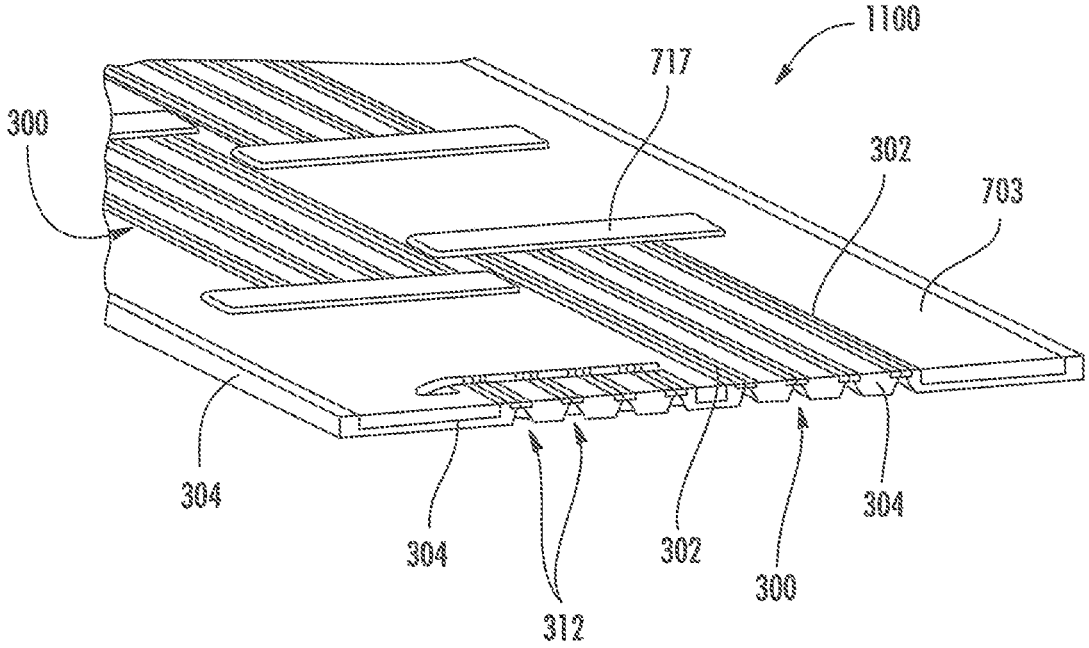
FIG. 13 is a perspective sectional view of the example fluid ejection assembly of FIG. 12.

FIGS. 12 and 13 illustrate perspective views of a molded media-wide fluid ejection assembly 1100 with multiple fluid ejection devices 300, for example for inclusion in a print cartridge, page wide array print bar or printer. FIG. 13 illustrates a different, section view of FIG. 12. The molded fluid ejection assembly 1100 includes multiple fluid ejection devices 300 and a PCB 703 that are both mounted to a molding 304.

As shown by FIG. 7, molding 304 comprises a molded structure that includes an elongate channel or fluid supply passage 312 for supplying fluid to the fluid feed holes of a die. In the example illustrated in which each fluid ejection device 300 includes four fluid ejection dies 302, molding 304 comprises at least four fluid supply passages 312, at least one fluid supply passage 312 for each of the four fluid ejection dies 302. In the example illustrated, each of the four dies is embedded in the molding 304, wherein fluid supply passage is part of the molded structure and the fluid feed holes are part of the die. In the example illustrated, the molded structure provided by molding 304 at least partially encapsulates each of the dies 302. In the example illustrated, molded structure or molding 304 encapsulates the parallel and end aligned dies 302 of each set of four dies as well as the staggered sets themselves.

The fluid ejection devices 300 are arranged within windows 748 cut out of the PCB 703. The fluid ejection devices are arranged lengthwise in rows across the fluid ejection assembly 1100. The fluid ejection devices 300 of opposite rows are arranged in a staggered configuration with respect to each other so that each fluid ejection device 300 overlaps part of an opposite, adjacent fluid ejection device 300, as seen in a media advance direction. Hence some of the drop generators at the end of the fluid ejection dies 302 may be redundant because of the overlap. Although ten fluid ejection devices 300 are illustrated in FIG. 13, more or fewer fluid ejection devices 300 may be used in the same or a different configuration. At either end of the fluid ejection dies 302 of each fluid ejection device 300 bond wires can be provided that may be covered by low profile protective coverings 717 that may comprise a suitable protective material such as an epoxy, and a flat cap placed over the protective material.

Although the present disclosure has been described with reference to example implementations, workers skilled in the art will recognize that changes may be made in form and detail without departing from the spirit and scope of the claimed subject matter. For example, although different example implementations may have been described as including features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A fluid ejection device comprising:
thermal resistive fluid actuators;
ejection chambers adjacent the fluid actuators;
nozzles extending from the ejection chambers;
fluid feed holes to supply fluid from a fluid supply passage to the ejection chambers, the fluid feed holes having ports connected to the ejection chambers, the ports being dimensioned to pass bubbles out of the ejection chambers.

2. The fluid ejection device of claim 1 comprising:
a substrate;
a fluidic layer disposed on the substrate, wherein the ejection chambers are formed in the fluidic layer and have a height; and
wherein the fluid feed holes extend through the substrate from the fluid supply passage, each of the fluid feed holes having a port connected to at least one of the ejection chambers, the port having a minimum dimension of at least 1.5 times the height.

3. The fluid ejection device of claim 2, wherein the ejection chambers are fluidly connected in the fluidic layer.

4. The fluid ejection device of claim 3, wherein the fluidic layer comprises at least one constriction between the ejection chambers.

5. The fluid ejection device of claim 2, wherein the ejection chambers are isolated from one another in the fluidic layer.

6. The fluid ejection device of claim 1, wherein the ports have a minimum dimension that is no greater than 100 μm.

7. The fluid ejection device of claim 2, wherein the substrate has a front surface on which the fluidic layer is formed and a back surface to receive fluid from the fluid supply passage, the fluid feed holes being separated by ribs in the substrate and extending from the back surface to guide fluid from the back surface to the fluidic layer.

8. The fluid ejection device of claim 1, wherein each of the fluid feed holes is to supply fluid to a plurality of the ejection chambers.

9. The fluid ejection device of claim 1, wherein the fluid feed holes are tapered.

10. The fluid ejection device of claim 1, wherein, the port has a minimum dimension of at least 2 times the height.

11. The fluid ejection device of claim 1 wherein the fluid supply passage is part of a molded structure and the fluid feed holes are part of a die.

12. The fluid ejection device of claim 11 wherein the molded structure at least partially encapsulates a single die or a plurality of parallel dies or a plurality of staggered dies.

13. The fluid ejection device of claim 12 wherein the molded structure comprises at least one fluid passage per die.

14. The fluid ejection device of claim 1 comprising a fluidic die having a length: width ratio of at least 30:1.

15. A fluid ejection device comprising:
a substrate;
a fluidic layer disposed on the substrate;
drop generators formed in the fluidic layer, the drop generators comprising respective ejection chambers; respective nozzles extending from respective ejection chambers and respective fluid actuators, each of the ejection chambers having a height; and
fluid feed holes extending through the substrate from a single fluid supply passage, each of the fluid feed holes having a port connected to at least one of the ejection chambers, the port having a minimum dimension of at least 1.5 times the height and each of the ejection chambers having a height no greater than two thirds a minimum dimension of each of the ports.

16. A fluid ejection device comprising:
fluid actuators;
ejection chambers adjacent the fluid actuators;
nozzles extending from the ejection chambers;
fluid feed holes to supply fluid from a fluid supply passage to the ejection chambers, the fluid feed holes having ports connected to the ejection chambers, the ports being dimensioned to pass bubbles out of the ejection chambers;
a substrate;
a fluidic layer disposed on the substrate, wherein the ejection chambers are formed in the fluidic layer and have a height; and
wherein the fluid feed holes extend through the substrate from the fluid supply passage, each of the fluid feed holes having a port connected to at least one of the ejection chambers, the port having a minimum dimension of at least 1.5 times the height; and
wherein the fluidic layer comprises a nozzle layer through which the nozzles extend and a barrier layer sandwiched between the nozzle layer and the substrate, the barrier layer forming the ejection chambers, the barrier layer having a thickness no greater than one half the minimum dimension of the port.

* * * * *